US006075429A

United States Patent [19]

Uotome et al.

[11] Patent Number: 6,075,429

[45] Date of Patent: Jun. 13, 2000

[54] SINGLE POLE RELAY SWITCH

[75] Inventors: Riichi Uotome, Katano; Takehiko Toguchi, Kadoma; Ritsu Yamamoto, Neyagawa; Masahiro Ito, Watarai-gun; Narutoshi Hoshino, Hirakata, all of Japan

[73] Assignee: Matsushita Electric Works, Ltd., Osaka, Japan

[21] Appl. No.: 09/373,581

[22] Filed: Aug. 13, 1999

[30] Foreign Application Priority Data

Aug. 26, 1998 [JP] Japan ..... 10-257541
May 26, 1999 [JP] Japan ..... 11-146734

[51] Int. Cl.[7] ..... H01H 51/22

[52] U.S. Cl. ..... 335/78; 335/129; 335/130; 335/154

[58] Field of Search ..... 335/78–86, 154, 335/124, 128, 129, 130, 131, 132, 202

[56] References Cited

U.S. PATENT DOCUMENTS

| | | | |
|---|---|---|---|
| 5,519,370 | 5/1996 | Perreira et al. | 335/154 |
| 5,546,061 | 8/1996 | Okabayashi et al. | 335/78 |
| 5,554,962 | 9/1996 | Perreira et al. | 335/78 |
| 5,831,502 | 11/1998 | Kirsch | 335/129 |
| 5,892,194 | 4/1999 | Uotome et al. . | |
| 5,903,201 | 5/1999 | Reiss | 335/128 |

*Primary Examiner*—Lincoln Donovan
*Assistant Examiner*—Tuyen T. Nguyen
*Attorney, Agent, or Firm*—Arent Fox Kintner Plotkin & Kahn, PLLC

[57] ABSTRACT

A single-pole relay switch capable of effective arc extinction irrespective of the current flowing directions in which the device is connected in a circuit. The switch has a housing and two sets of contacts located in the housing, each set being composed of a fixed contact and a movable contact. A contact carrier is provided to have first and second movable arms which extend commonly from a bridge and are provided respectively with the two movable contacts. An actuator applies a driving force to move the contact carrier between an ON-position of holding the movable contacts simultaneously in contact respectively with the fixed contacts, and an OFF-position of keeping the movable contacts at respective opening gaps from the fixed contacts. The housing includes a casing which is divided into first and second chambers respectively for receiving the contact sets, each of the first and second chambers being surrounded by a dielectric wall. Permanent magnet are disposed around the casing to stretch the individual arcs in opposing directions to each other and towards the dielectric walls of the first and second chambers, respectively. Thus, the individual arcs can be stretched individually within the separate chambers, i.e., in an isolated condition. Therefore, the individual arcs can be free from merging even when the current flows in such a direction as to drive the arcs in the approaching direction.

12 Claims, 8 Drawing Sheets

SINGLE POLE RELAY SWITCH

BACKGROUND OF THE INVENTION

1. Field of the Invention

The present invention is directed to a single-pole relay switch, and more particularly to a relay switch with a pair of fixed contact which are conducted with or interrupted from each other by a common movable member in an arc-extinguishing environment.

2. Description of the Prior Art

U.S. Pat. No. 5,892,194 discloses a contact device with a pair of fixed contacts which are closed and opened by a common movable contact within a sealed compartment of an elongated configuration. The fixed contacts are spaced along the length of the compartment and form a pair of two parallel opening paths or gaps with the movable contact moving away from the fixed contacts. Permanent magnets are disposed around the compartment to generate a magnetic field which drives arcs each extending between the movable contact and the fixed contacts for stretching arcs in opposite directions of moving the individual arcs away from each other towards the opposite end walls of the compartment for rapid extinction of the arcs. However, this arc drive is effective only when the current flows in one predetermined direction. That is, when fixed contacts are connected oppositely to flow the current in the direction opposite the predetermined direction, the individual arcs are driven by the magnetic field to stretch towards to each other, resulting in merger of the arcs which causes undesired shorting between the fixed contacts through the merged arc. Thus, the above prior contact device requires to be connected only in a predetermined current direction for making the use of the arc drive by the permanent magnets.

SUMMARY OF THE INVENTION

In view of the above problem, the present invention has been accomplished to provide a single-pole relay switch which is capable of effective arc extinction irrespective of the current flowing directions in which the device is connected in a circuit. The relay switch in accordance with the present invention comprises a housing and two sets of contacts located in the housing, one set being composed of a first fixed contact and a first movable contact, and the other being composed of a second fixed contact and a second movable contact. A contact carrier is provided to have first and second movable arms which extend commonly from a bridge and are provided respectively with the first and second movable contacts. The device includes an actuator which applies a driving force to move the contact carrier between an ON-position of holding the first and second movable contacts simultaneously in contact respectively with the first and second fixed contacts, and an OFF-position of keeping the first and second movable contacts at respective opening gaps from the first and second fixed contacts. Permanent magnets are provided to generate a magnetic field around the first and second fixed contacts for stretching arcs developed respectively between the first movable and fixed contacts and between the second movable and fixed contacts. The housing includes a casing which is divided into first and second chambers respectively for receiving the first and second fixed contacts as well as the first and second movable contacts, each of the first and second chambers being surrounded by a dielectric wall. The permanent magnet are disposed around the casing to stretch the individual arcs in opposing directions to each other and towards the dielectric walls of the first and second chambers, respectively. Thus, the individual arcs can be stretched individually within the separate chambers, i.e., in an isolated condition. Therefore, the individual arcs can be free from merging even when the current flows in such a direction as to drive the arcs in the approaching direction.

Accordingly, it is a primary object of the present invention to provide a single-pole relay switch which is capable of effective arc extinction regardless of the current flowing direction, i.e., polarity at which the device is connected in circuit.

In a preferred embodiment, an advantageous feature is proposed to assure reliable switching operation over an extended period of use. The fixed and movable contacts will suffer from wearing after a repeated contact closing and opening, which may bring about unbalanced opening gaps between the two contact sets. If this occurs, the individual movable contacts are required to travel by different distances in order to make reliable contact closing. In consequence of the provision of the separate contact chambers, the contact carrier is required to have the first and second arms which extend respectively into the separate contact chambers. Thus, the first and second movable arms are required to move by different distances or opening gaps in order to effect closing of the first and second contacts. To this end, the contact device is provided with a differential mechanism which allows one of the first and second arms to move relative to the other in a direction of closing the corresponding movable contact with the associated fixed contact when the contact carriers receives the driving force from the actuator to move into the ON-position, thereby successfully closing the first and second movable contacts, irrespective of a possible error between the opening gaps of the two contact sets.

Accordingly, it is another object of the present invention to provide a single-pole relay switch which is capable of assuring reliable contact closing over a long period of use.

The above differential mechanism may be realized in a combination of the actuator and the contact carrier of specific configurations. The actuator supports a header of electrically insulative material. And, the contact carrier is in the form of a generally U-shaped configuration with the first and second arms which are parallel to each other and are connected by the bridge at the ends opposite of the first and second movable contacts. The bridge is rigidly connected to the header for receiving the drive force from the actuator in order to move the contact carrier into the ON-position along a lengthwise direction of the first and second arms. The header is pivotally supported onto the actuator in such a manner as to allow the contact carrier to pivot together with the header about a pivot axis perpendicular to a plane including the first and second arms when the contact carrier is driven to move into said ON-position.

Alternatively, the above differential mechanism may be a pivotal connection of the contact carrier to a like header supported on the actuator. The bridge of the contact carrier is formed intermediate its length between the first and second arms with a prop which is connected to the header for receiving the drive force from the actuator in order to move the contact carrier into the ON-position along a lengthwise direction of the first and second arms. The pivotal connection allows the contact carrier to pivot about an pivot axis perpendicular to a plane including the first and second arms when the contact carrier is driven to move into said ON-position.

These and still other objects and advantageous features of the present invention will become more apparent from the following detailed description of the preferred embodiments when taken in conjunction with the attached drawings.

DETAILED DESCRIPTION OF THE EMBODIMENTS

First Embodiment FIGS. 1 to 6

Figure 1:
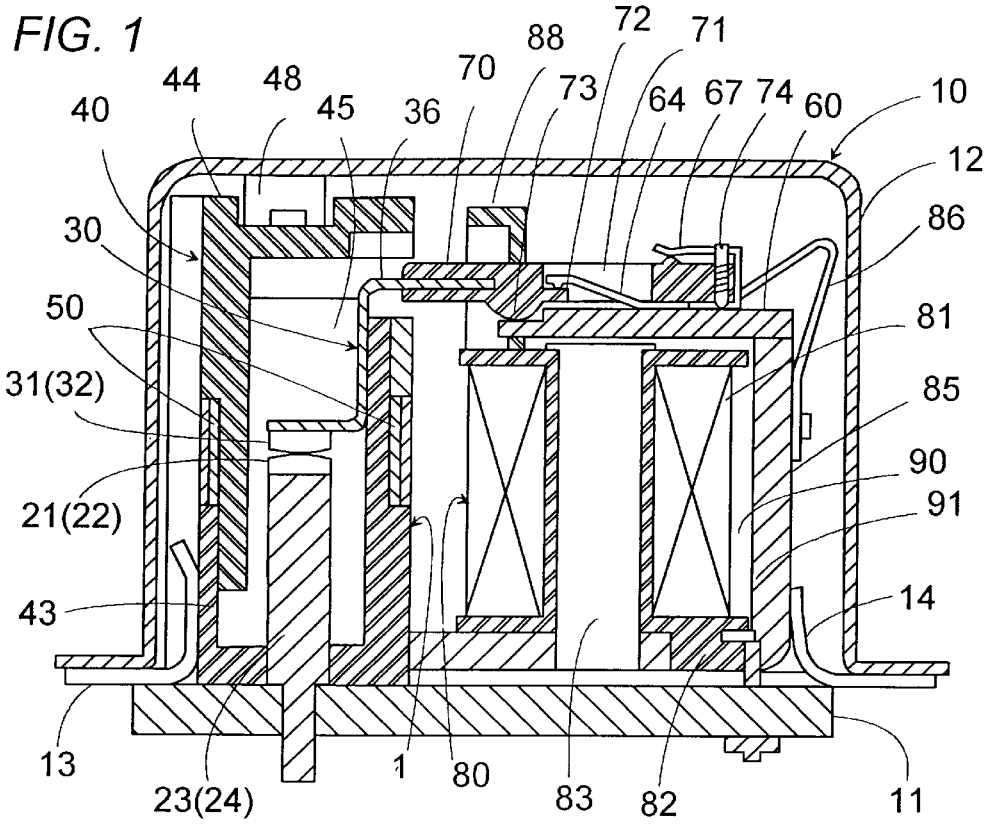
FIG. 1 is a vertical section of a single-pole relay switch in accordance with a first embodiment of the present invention.
Figure 2:
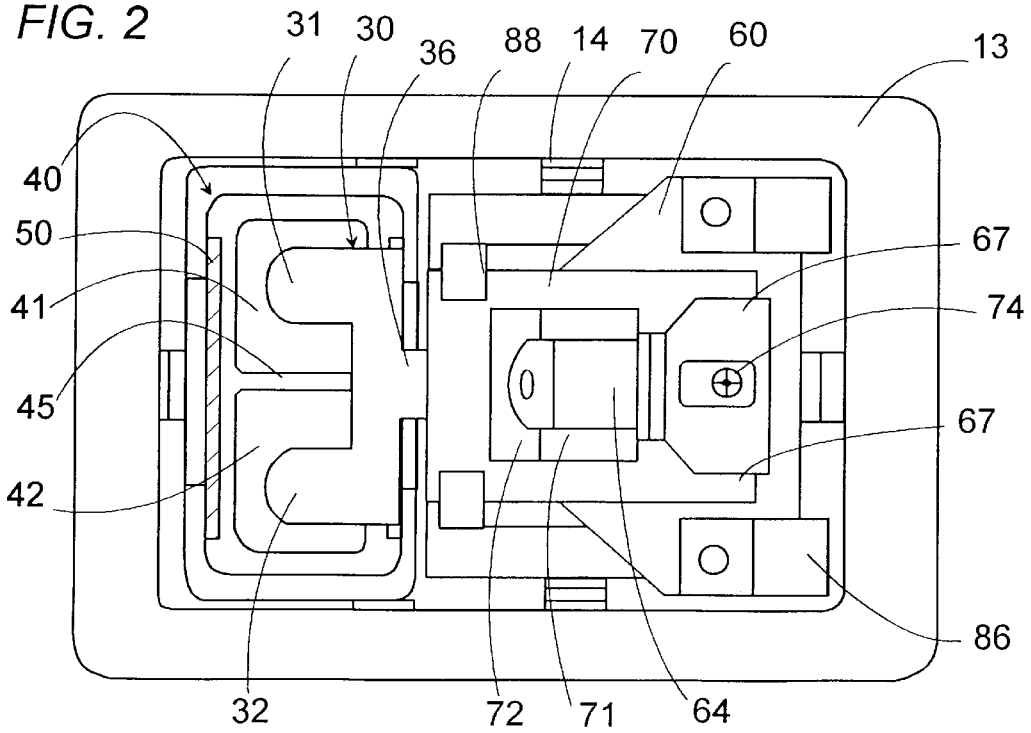
FIG. 2 is a top view of the relay switch shown with its cover and a top portion removed.
Figure 3:
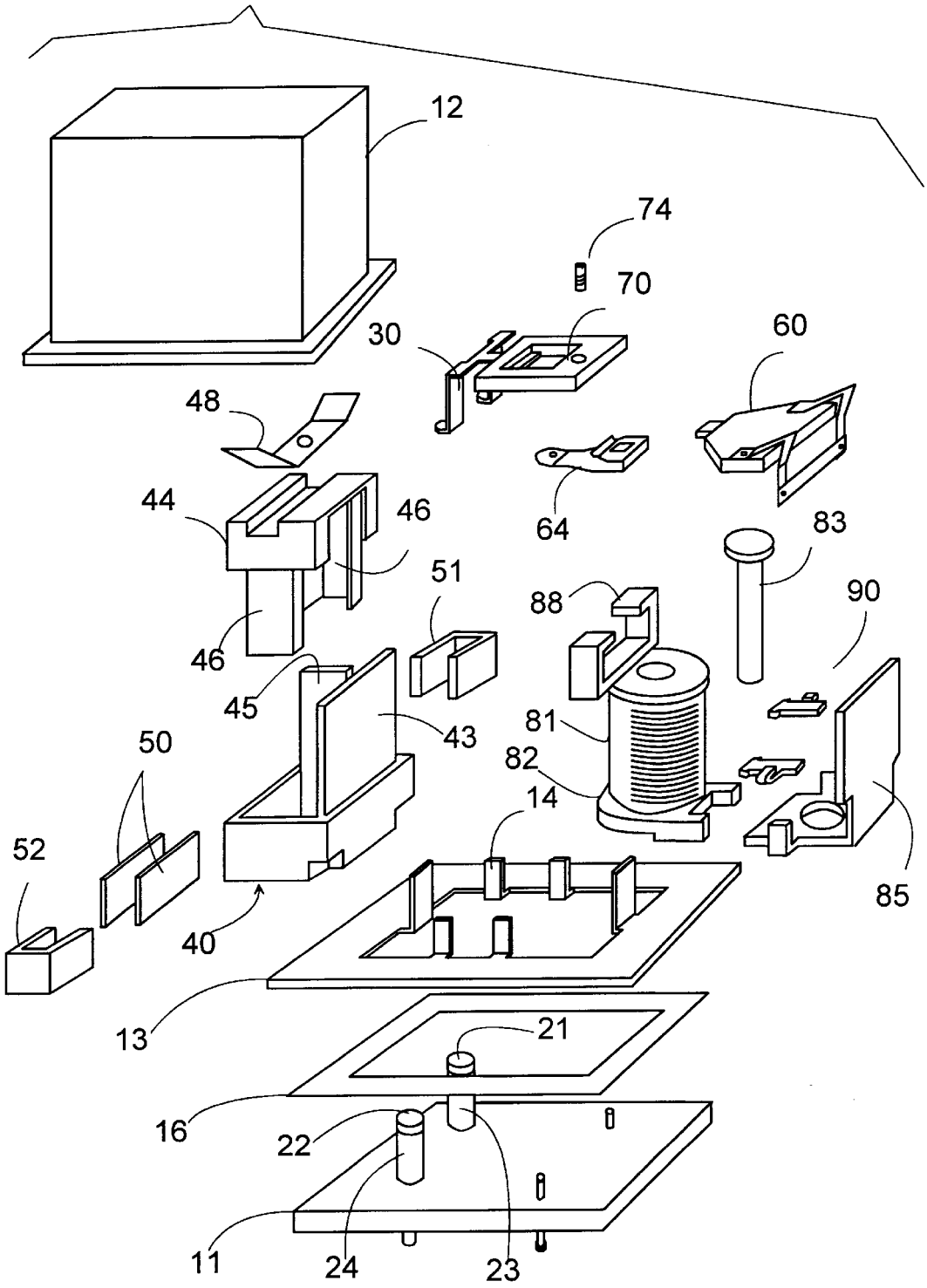
FIG. 3 is an exploded perspective view of the relay switch.
Figure 4:
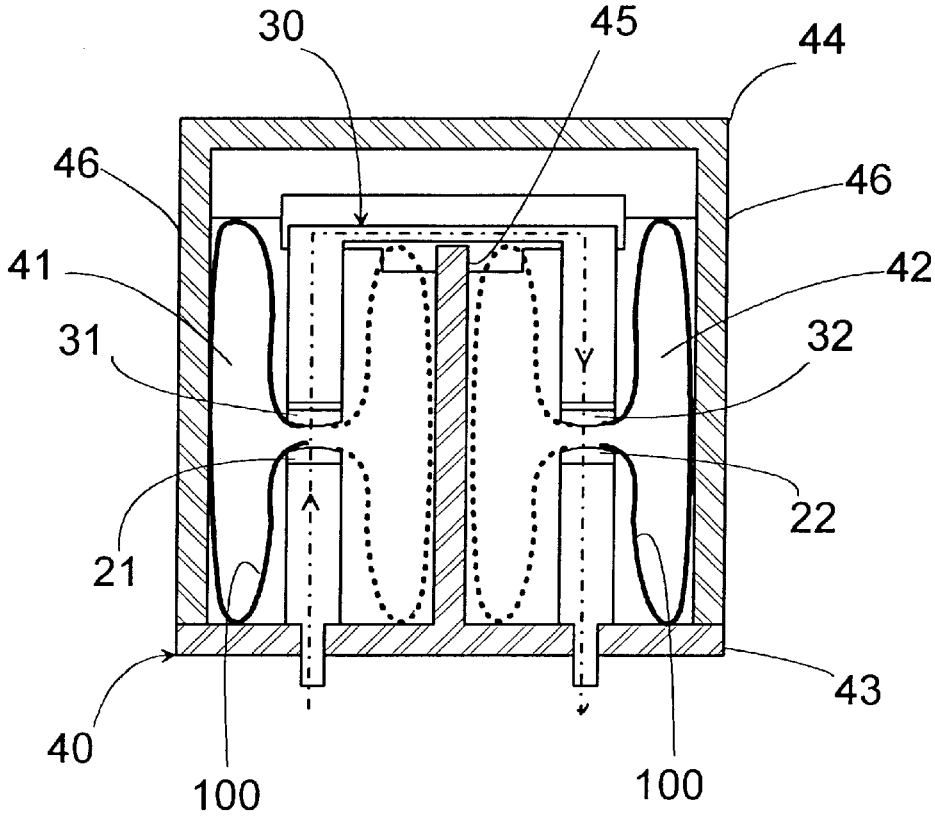
FIG. 4 is a vertical section of a casing of the relay switch.

Referring now to FIGS. 1 to 3, there is shown a single-pole relay switch in accordance with a first embodiment of the present invention. The relay switch is utilized, for example, as a high voltage DC power relay or the like for controlling a high electric current. The relay switch has a hermetically sealed housing 10 accommodating therein a contact block 1 and an electromagnet block 80 in a side-by-side relation. The contact block 1 includes a contact carrier 30 having first and second movable contacts 31 and 32 which engage with and disengage from first and second fixed contacts 21 and 22 respectively for conduction and interruption between the first and second fixed contacts. The electromagnet block 80 includes an excitation coil 81 and an armature or actuator 60 which is driven to move the contact carrier 30 into an ON-position of closing the contacts upon energization of the coil 81. A return spring 86 is provided to urge the actuator 60 in the direction of moving the contact carrier 30 into an OFF-position of opening the contacts when the coil is deenergized. The housing 10 is filled with a hydrogen gas or hydrogen-rich gas for expediting to extinguish an arc developed between the opening contacts.

The housing 10 is composed of a base plate 11 of a dielectric ceramic material and a bottom-open rectangular cover 12 which is bonded to the base plate 11 through an annular sealing metal plate 13. A brazing sheet 16 is interposed between the metal plate 13 and the base plate 11 to effect secure brazing connection therebetween. The metal plate 13 is provided with a plurality of tabs 14 upstanding from an inner periphery of the plate for rigid connection with the contact block 1 and the electromagnet block 80.

As shown in FIG. 3, the contact block 1 has a rectangular casing 40 of a dielectric material which is composed of a base box 43 and an upper box 44. The interior of the casing 40 is divided by a partition 45 into first and second chambers 41 and 42 respectively for receiving the first movable contact 31 and the first fixed contact 21 and for receiving the second movable contact 32 and the second fixed contact 22, as show in FIG. 4. The first and second fixed contacts 21 and 22 are formed respectively on terminal pins 23 and 24 extending through the base plate 11. The contact carrier 30 is shaped into a generally U-shaped configuration with the first and second parallel arms 33 and 34 which carry the first and second movable contacts 31 and 32 at their respective lower ends. The upper ends of the first and second arms 33 and 34 are connected integrally by a bridge 35 which is connected to the actuator 60 so that the contact carrier 30 is driven by the actuator 60 to move between the ON-position and OFF-position along the length of the first and second arms 33 and 34. The first and second arms 33 and 34 are also received respectively within the first and second chambers 41 and 42. A pair of permanent magnets 50 of opposite polarity are disposed around the casing 40 to provide a magnetic field which applies on arcs being developed between the opening contacts in order to stretch the arcs in opposing directions. That is, when the terminal pins 23 and 24 are connected in a load circuit to flow a DC current in a direction indicated by arrows in FIG. 4, the arcs 100 are stretched towards the end walls 46 of the casing 40, as indicated by solid lines in FIG. 4, to effect a rapid rise of arc voltage for extinction of the arc. When the terminal pins 23 and 24 are connected to the opposite polarity to flow the DC current in the opposite direction, the arcs 100 are stretched towards the partition 45, as indicated by dotted lines in FIG.4, also resulting in rapid rise of arc voltage for extinction of the arc. The casing 40 or at least inner walls of the casing may be formed from an ablative arc extinguishing material such as unsaturated polyester, Nylon, or the like having a high rate of ablation under the influence of the arc to generate a deionizing gas for prompting the arc extinction.

The permanent magnets 50 are held in position by clips 51 and 52 fitted around the casing 40. The upper box 44 is pressed fitted to the base box 43 by a retainer spring 48 compressed between the upper box 44 and the top of the cover 12. The lower end of the base box 43 is formed with dents which are engaged with the tabs 14 of the metal plate 13. After a number of repeated contact opening and closing, the contacts are worn to scatter debris of contact material which will be accumulated around the first and second fixed contacts 21 and 22 respectively. However, the partition 45 acts to separate masses of contact debris accumulated around the first and second contacts, preventing the formation of a shorting path of the contact debris between the two fixed contacts.

The electromagnet block 80 includes a coil bobbin 82 winding therearound the coil 81 and receiving therethrough a core 83 which defines a pole end at its upper end and is connected at its lower end to an L-shaped yoke 85. The actuator 60 is pivotally supported at its rear end on the upper end of the yoke 85 to position the front end of the actuator 60 in an opposed relation to the pole end. The coil bobbin 82 carries a pair of terminal lugs 90 for wiring connection respectively with the opposite ends of the coil 81 and for electrical connection respectively with coil pins 91 extending through the base plate 11. Each lug 90 has a spring portion against which the upper end of the coil pin 91 is pressed for establishing the electrical connection.

Figure 5:
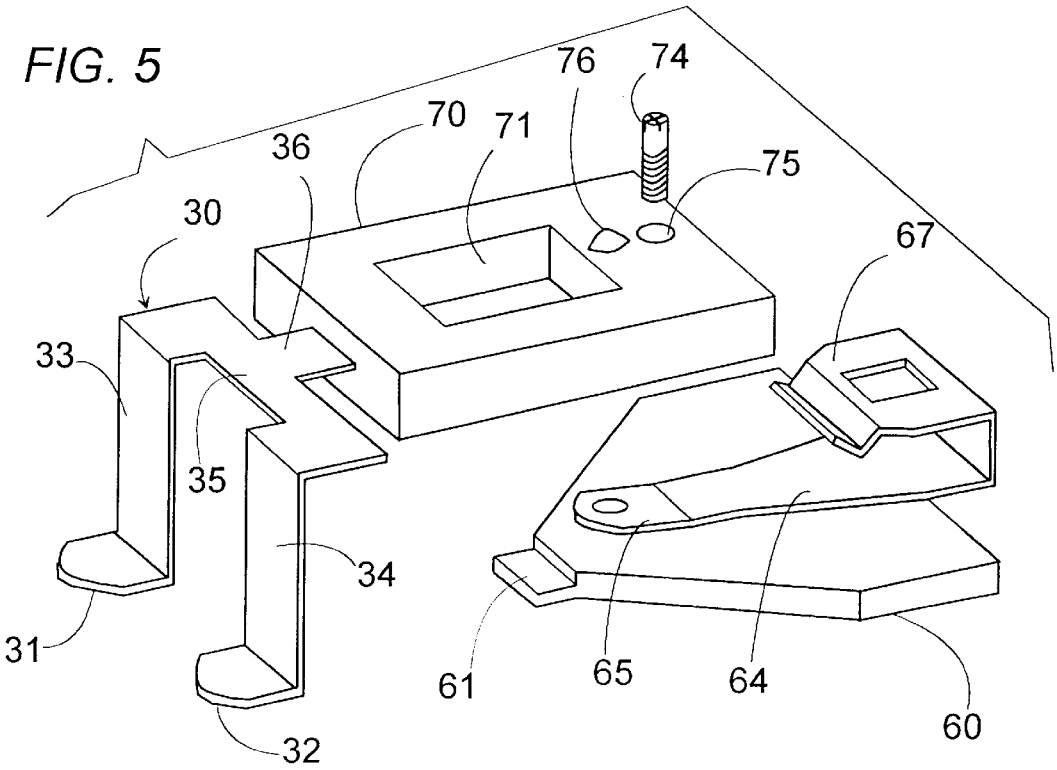
FIGS. 5 and 6 are exploded perspective views of an actuator of the relay switch.

As shown in FIG. 5, the actuator 60 supports a header 70 of a dielectric material which in turn supports the contact carrier 30. An over-travel spring 64 is provided to interconnect the header 70 to the actuator 60 with a rear end of the spring 64 secured on the actuator 60. The spring 64 has its front end engaged with a front portion of the header 70 to give a bias of urging the header and the contact carrier 30 in a direction of developing a contact pressure for the closed contacts. The header 70 has an opening 71 with a tongue 72 extending from the front bottom periphery of the opening for engagement with the front end of the spring 64, as best shown in FIG. 1. The contact carrier 30 is formed at a longitudinal center of the bridge 35 with a prop 36 for rigid connection to the front center of the header 70.

Figure 6:
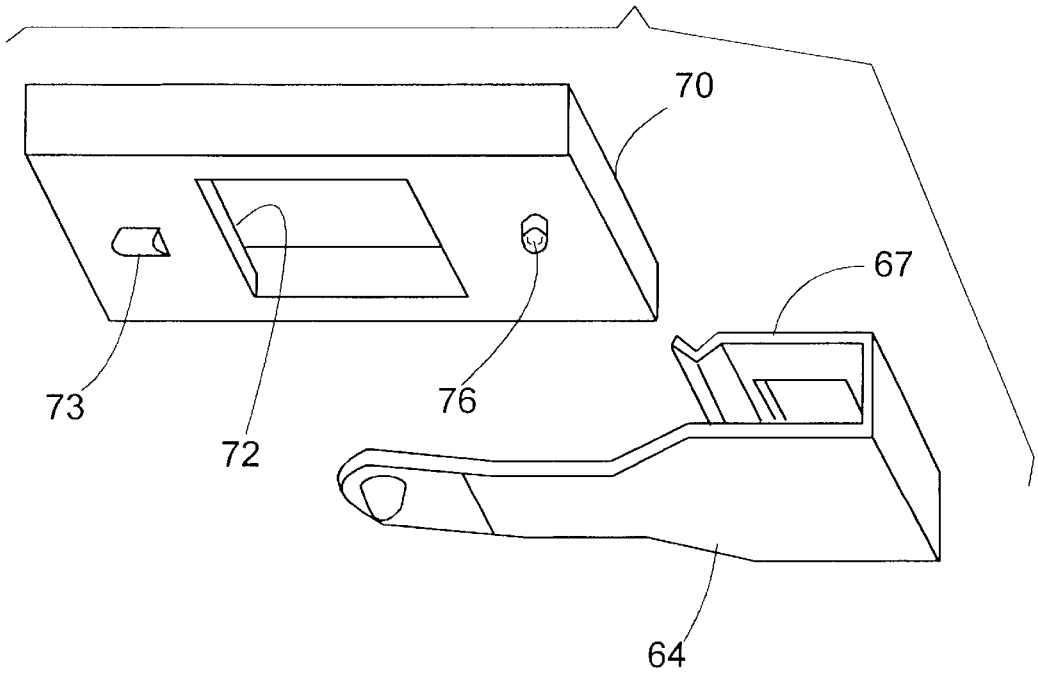
Figure 8:
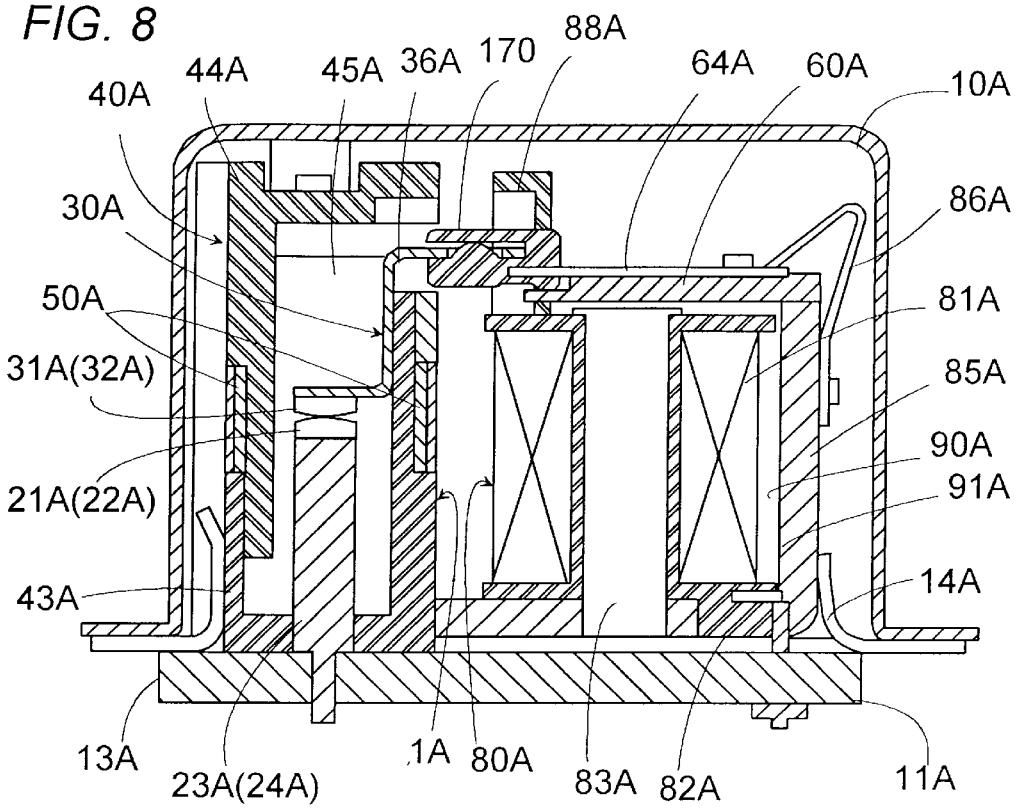
FIG. 8 is a vertical section of a single-pole relay switch in accordance with a second embodiment of the present invention.
Figure 9:
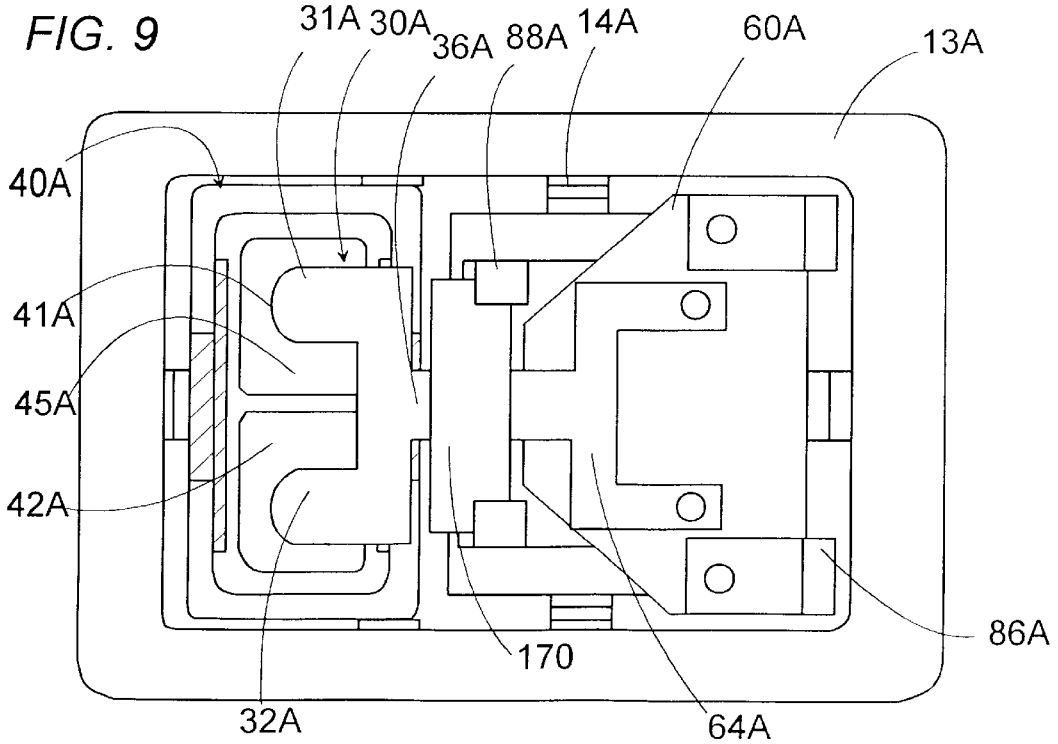
FIG. 9 is a top view of the relay switch shown with its cover removed.
Figure 10:
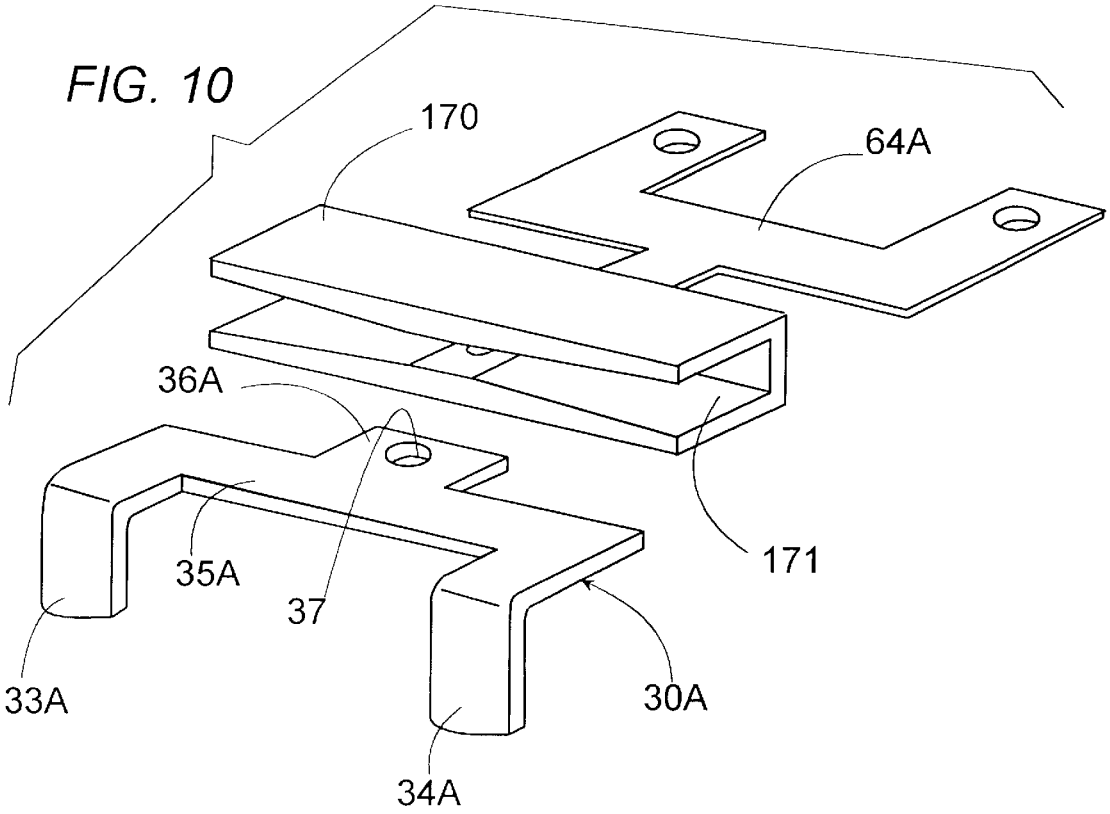
FIG. 10 is an exploded perspective view of a connection between a contact carrier and a header employed in the above relay switch.

As shown in FIG. 6, the header 70 is formed on its bottom at a widthwise center thereof with a rounded projection or fulcrum 73 which rests on a stepped front end 61 of the actuator 60 so that the header 70 is pivotally supported on the actuator 60 to be capable of rolling about an horizontal pivot axis perpendicular to a vertical plane in which the first and second movable contacts 31 and 32 are arranged. Thus, the header 70 can pivot or roll about the pivot axis together with the contact carrier 30 within a limited extent, thereby assuring reliable engagement of the first and second movable contacts 31 and 32 respectively with the first and second fixed contacts 21 and 22, when the contact carrier is moved into the ON-position, irrespective of a possible error between a first opening gap of the first movable contact 31 relative to the first contact 21 and a second opening gap of the second movable contact 32 relative to the second fixed contact 22. Such error is likely to occur due to contact wearing after a large number of repeated contact closing and opening. However, with the provision of the pivotable header 70 which transmits a force of closing the contacts from the actuator 60, the contact carrier 30 is capable of rolling about the pivot axis in order to bring the first and second movable contacts 31 and 32 into stable contact with the first and second fixed contacts 21 and 22 while the contact carrier 30 is driven to move further downwards. In this sense, the pivotal support of the header 70 to the actuator 60 constitutes a differential mechanism which compensates for the errors in the opening gaps between the first and second contact sets.

The over-travel spring 64 is formed at its rear end with a retainer hook 67 which engages with the rear end of the header 70 to give a counterbalancing force with respect to the biasing force applied to the front end of the header, thereby restraining the header 70 from fluctuating about a transverse horizontal axis perpendicular to the pivot axis in a direction of varying the opening gap of the contacts. In order not to contrain the pivotal movement of the header 70 by the retainer hook 67, the header 70 is formed with a rounded projection 76 against which the retainer hook 67. Although retainer hook 67 is preferred, it is not essential and may be eliminated. An adjuster screw 74 extends through a threaded hole 75 in the rear end of the header 70 to have its lower end abutting against the actuator 60 in order to vary an angle at which the header 70 is inclined with respect to the actuator 60 about the transverse horizontal axis, thereby adjusting the opening gaps of the movable contacts 31, 32 in relation to the fixed contacts 21, 22. The lower end of the screw 74 is rounded to form another fulcrum 76 which is aligned with the fulcrum 73 along the pivot axis, as shown in FIG. 6. A stopper 88 is formed on top of the coil bobbin 82 to engage with the header 70 to retain the armature 60 in the OFF-position against the bias of the return spring 86.

Figure 7:
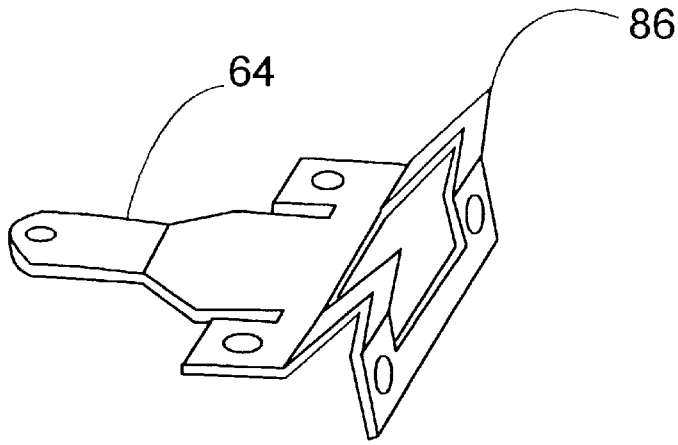
FIG. 7 is a perspective view illustrating a combination spring which may be utilized in the above embodiment.

In the above embodiment, the over-travel spring 64 is formed separately from the return spring 86, they may be formed as an integral part, as shown in FIG. 7.

Second Embodiment FIGS. 8 to 12

Figure 11:
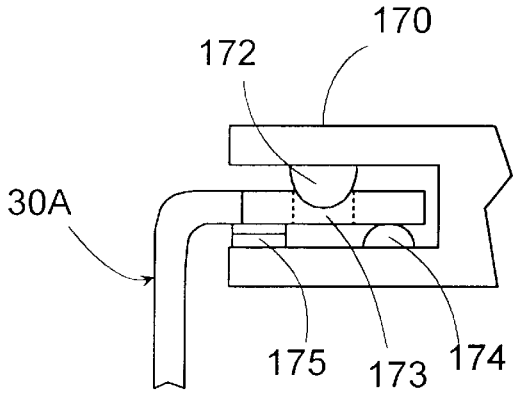
FIG. 11 is a front view of the connection between the contact carrier and the header.

Referring to FIGS. 8 to 12, there is shown a single-pole relay switch in accordance with a second embodiment of the present invention, which is identical to the first embodiment except that a contact carrier 30A is pivotally supported to a header 170 of an actuator 60A. Like parts are designated by like numerals with a suffix letter of is "A". A like over-travel spring 64A extends from the actuator 60A of electromagnet block to the header 170 of a dielectric material with the rear end of the spring secured to the actuator 60A and with the front end of the spring fixedly inserted to the header 170. The header 170 is formed to have a horizontally extending slit 171 for connection with a prop 36A of the contact carrier 30A. As shown in FIG. 11, a ball-shaped projection 172 is formed on an upper wall of the slit at a longitudinal center of the slit 171 and projects into a round-hole 37 in the prop 36A of the contact carrier 30A to give a swivel joint by which the contact carrier 30A is capable of pivoting about a horizontal pivot axis perpendicular to a plane including the first and second movable contacts 31A and 32A, thus assuring the contact closing sucessfuly even in the presence of the error between the opening gaps of the first and second contact sets. That is, even when there remains an opening gap between one of the contact sets as shown in FIG. 12B, after the contact carrier 30A is driven to move from the OFF-position of FIG. 12A, the contact carrier 30A is allowed to pivot while being driven to move further downward, thereby enabling both of the first and second movable contacts into engagement with the corresponding fixed contacts as shown in FIG. 12C. Thus, the pivotal support of the contact carrier 30A to the header 170 constitutes a like differential mechanism of compensating for the errors in the opening gaps between the first and second contact sets.

Figures 12A, 12B, 12C:
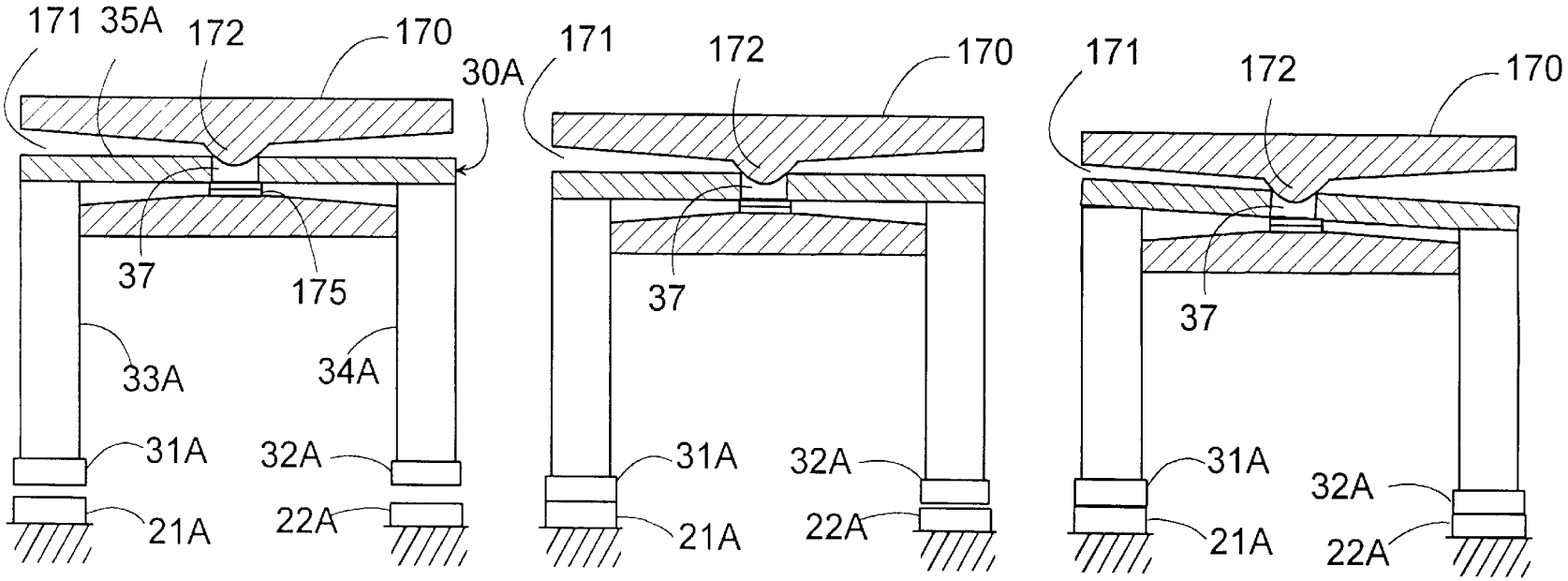
FIGS. 12A, 12B, and 12C are explanatory views of the operations of the relay switch.

The opposed walls of the slit 171 are inclined so that the slit 171 has a slit gap which is wider towards the opposite longitudinal ends of the slit than at a longitudinal center of the slit where the contact carrier 30A is supported to the header 170. With this consequence, the prop 36A of the contact carrier 30A is allowed to pivot within a large angular range, as shown in FIGS. 12C, increasing a capability of achieving the simultaneous contact closing.

As shown in FIG. 11, a stopper 174 is formed to project on the lower wall of the slit 171 at a position offset rearwardly of the projection 172 for abutment against the rear end of the prop 36A. A spring 175 is disposed forwardly of the projection 172 to urge the prop 36A in a direction of being pressed against the stopper 174 in order to prevent the contact carrier 30A from pitching about a horizontal axis transverse to the horizontal pivot axis, thereby eliminating fluctuation of the opening gaps irrespective of the pivotal support of the contact carrier 30A to the header 170.

Figure 13:
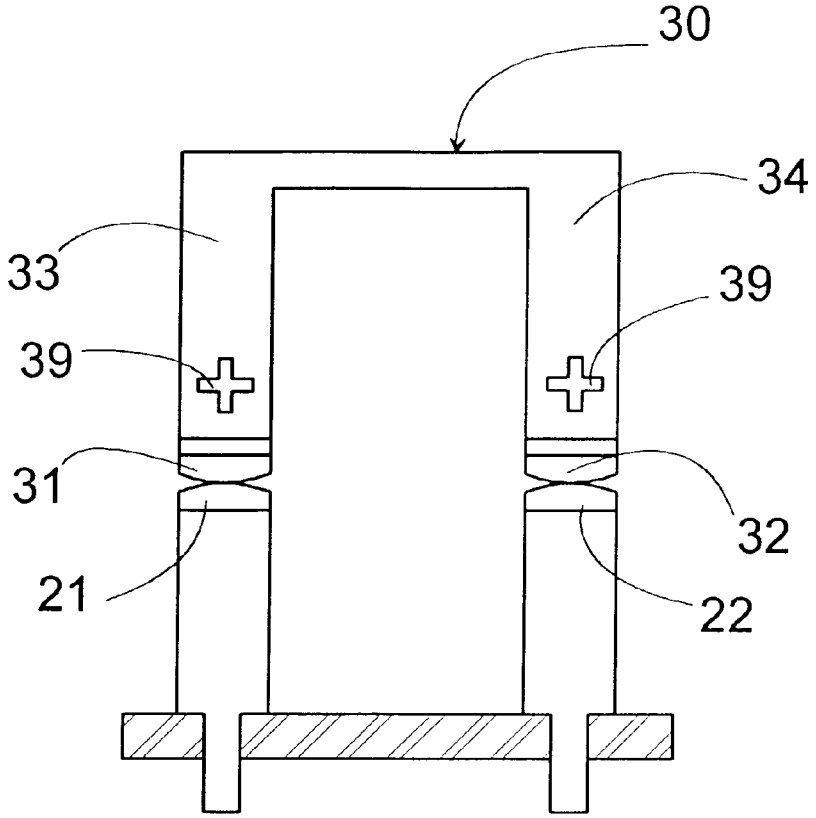
FIG. 13 is a side view of a modified contact carrier which may be utilized in the relay switch of the above embodiments.

In either of the above two embodiments, the first and second arms 33 and 34 of the contact carrier 30 may be formed at portions adjacent the movable contacts 31 and 32 respectively with cross-shaped slots 39, as shown in FIG. 13. The slots 39 can be readily deformed by making the use of ductility of the material, such as copper or the like metal from which the contact carrier is made, adjusting the length of the arms in compensation for an possible error of the opening gaps at the time of assembling the switch.

What is claimed is:

1. A single-pole relay switch comprising:

a housing;

two sets of opposing contacts disposed within said housing, one set of opposing contacts including a first fixed contact and a first movable contact positioned above said first fixed contact, and the other set of opposing contacts including a second fixed contact and a second movable contact positioned above said second fixed contact;

a contact carrier having first and second arms commonly extending from a bridge wherein said first and second arms carry said first and second movable contacts at respective lower ends of said arms;

an actuator which applies a driving force to move said contact carrier between an ON-position of holding the first and second movable contacts simultaneously in contact respectively with the first and second fixed contacts for conduction of said first fixed contact with said second fixed contact through said contact carrier, and an OFF-position of keeping the first and second movable contacts at respective opening gaps from said first and second fixed contact; and permanent magnet means which generates a magnetic field around the first and second fixed contacts for stretching arcs developed respectively between the first movable and fixed contacts and between the second movable and fixed contacts;

wherein said housing includes a casing which is divided by a unitary partition into first and second chambers respectively for receiving said first and second fixed contacts as well as said first and second movable contacts, each of said first and second chambers being surrounded by a dielectric wall, said permanent magnet means is disposed around the casing to stretch the individual arcs in opposing directions to each other and towards the dielectric walls of said first and second chambers, respectively.

2. The single-pole relay switch as set forth in claim 1, wherein said contact carrier is movable along the length of said first and second arms between said ON-position and OFF-position;

a differential means is included to allow one of said first and second arms to move relative to the other in a direction of closing the corresponding movable contact with the associated fixed contact when said contact carrier receives the driving force from said actuator to move into said ON-position, thereby making the first and second movable contacts into simultaneous contact respectively with the first and second fixed contacts irrespective of a possible gap error between said opening gaps of said two contact sets due to contact wearing developing during repeated contact closing and opening.

3. The single-pole relay switch as set forth in claim 2, wherein said actuator supports a header of electrically insulative material, said contact carrier being in the form of a generally U-shaped configuration with said first and second arms which are parallel to each other and are connected by said bridge at the ends opposite of said first and second movable contacts, said bridge being rigidly connected to said header for receiving the drive force from said actuator in order to move said contact carrier into said ON-position along a lengthwise direction of said first and second arms, said differential means comprising a pivotal support of said header onto said actuator, said pivotal support rendering said header to be pivotally supported on said actuator in such a manner as to allow said contact carrier to pivot together with said header about a pivot axis perpendicular to a plane including the first and second arms when said contact carrier is driven to move into said ON-position.

4. The single-pole relay switch as set forth in claim 3, wherein an over-travel spring (100) is connected between said actuator and said header to give a bias which develops a contacting pressure between the first and second movable contacts and the associated first and second fixed contacts in said ON-position, as well as enables said contact carrier to pivot in a direction of closing one of the first and second contacts which is not initially engaged with the associated fixed contact while keeping the other contact engaged with the associated fixed contact.

5. The single-pole relay switch as set forth in claim 3, wherein said header is formed on its bottom with a rounded projection by which said header is pivotally supported onto a generally flat upper surface of said actuator.

6. The single-pole relay switch as set forth in claim 4, wherein said over-travel spring extends from said actuator to have a leading end which is engaged with a front end of said header adjacent to said contact carrier in order to give said bias to said header, said over-travel spring further including a retainer which engages on a rear end of said header to give a counterbalancing force of preventing the fluctuation of said header about a horizontal axis perpendicular to said pivot axis.

7. The single-pole relay switch as set forth in claim 6, wherein an adjuster screw extends through the rear end of said header to have its lower end in abutment against said actuator to vary an angle at which said header is inclined with respect to said actuator about said horizontal axis, thereby adjusting said opening gaps of the first and second movable contacts in relation to said first and second fixed contacts.

8. The single-pole relay switch as set forth in claim 2, wherein said actuator supports a header of electrically insulative material, said contact carrier being in the form of a generally U-shaped configuration with said first and second arms which are parallel to each other and are connected by said bridge at the ends opposite of said first and second movable contacts, said bridge being formed intermediate its length between said first and second arms with a prop which is connected to said header for receiving the drive force from said actuator in order to move said contact carrier into said ON-position along a lengthwise direction of said first and second arms, said differential means comprises a pivotal connection of said contact carrier to said header;

said pivotal connection allowing said contact carrier to pivot about an pivot axis perpendicular to a plane including the first and second arms when said contact carrier is driven to move into said ON-position.

9. The single-pole relay switch as set forth in claim 8, wherein an over-travel spring (100) is connected between said actuator and said header to give a bias which develops a contacting pressure between the first and second movable contacts and the associated first and second fixed contacts in said ON-position, as well as enables said contact carrier to pivot in a direction of closing one of the first and second contacts which is not initially engaged with the associated fixed contact while keeping the other contact engaged with the associated fixed contact.

10. The single-pole relay switch as set forth in claim 8, wherein said header is formed in its front end with a horizontal slit for receiving therein said prop, said horizontal slit being defined between opposed upper and lower wall surfaces, one of said upper and lower wall surfaces being formed thereon with a ball-shaped projection which engages with a round hole in said prop for pivotally supporting said contact carrier to said header.

11. The single-pole relay switch as set forth in claim 10, wherein said upper and lower wall surfaces are inclined to have a slit gap which is wider toward the opposite longitudinal ends of said slit than at a longitudinal center of said slit where said ball-shaped projection is positioned.

12. The single-pole relay switch as set forth in claim 1, wherein said actuator is an armature connected to be driven by an electromagnet which is disposed in said housing in side-by-side relation to said casing, and said housing is hermetically sealed and is filled with a hydrogen gas.

* * * * *